United States Patent [19]

McKee

[11] Patent Number: 4,973,226

[45] Date of Patent: Nov. 27, 1990

[54] METHOD AND APPARATUS FOR CONTROLLING A WELL PUMPING UNIT

[75] Inventor: Fount E. McKee, Houston, Tex.

[73] Assignee: Delta-X Corporation, Houston, Tex.

[21] Appl. No.: 43,913

[22] Filed: Apr. 29, 1987

[51] Int. Cl.[5] ..... F04B 47/02

[52] U.S. Cl. ..... 417/18; 417/53

[58] Field of Search ..... 417/18, 22, 44, 45, 417/53; 73/151

[56] References Cited

U.S. PATENT DOCUMENTS

| | | | |
|---|---|---|---|
| 3,838,597 | 10/1974 | Montgomery et al. | 73/151 |
| 3,953,777 | 4/1976 | McKee | 318/474 |
| 4,145,161 | 3/1979 | Skinner | 417/45 X |
| 4,286,925 | 9/1981 | Standish | 417/12 |
| 4,307,395 | 12/1981 | Standish | 417/53 X |
| 4,390,321 | 6/1983 | Langlois | 417/53 X |
| 4,487,061 | 12/1984 | McTamaney et al. | 73/151 |
| 4,490,094 | 12/1984 | Gibbs | 417/53 X |
| 4,541,274 | 9/1985 | Purcupile | 417/44 |
| 4,594,665 | 6/1986 | Chandra et al. | 417/18 X |
| 4,661,751 | 4/1987 | Werner | 417/53 X |

*Primary Examiner*—Leonard E. Smith

*Attorney, Agent, or Firm*—Fulbright & Jaworski

[57] ABSTRACT

A method of maintaining a substantially constant amount of filling of a liquid well pump actuated by a polished rod which is reciprocated by a prime mover. The load and position of the polished rod is periodically measured to determine the amount of filling of the pump. The change in the amount of filling of the pump of one pumping cycle relative to a previous pumping cycle is compared and the speed of actuation of the pump is varied as a function of the change in the amount of filling of the pump to maintain a substantially constant amount of filling of the pump. The pump is continuously actuated but the speed is varied for preventing the well from being pumped dry.

4 Claims, 8 Drawing Sheets

METHOD AND APPARATUS FOR CONTROLLING A WELL PUMPING UNIT

BACKGROUND OF THE INVENTION

The most common method of pumping oil from an oil well is by the use of a downhole liquid pump which is actuated by a rod which is reciprocated from the well surface by a prime mover such as a motor or engine. Generally, the pumping system capacity is in excess of the productivity rate of the oil reservoir. This results in the well being pumped dry or "pumped off" causing fluid pound and damage to the rod string, pump, and possibly the surface equipment. Numerous control systems have been proposed, such as disclosed in U.S. Pat. Nos. 3,953,777, 4,286,925 and 4,487,061, to measure when the well has been pumped off and thereafter shut down the pumping unit for a predetermined amount of time.

However, there are circumstances when it is not desirable to stop the pumping. For example, if the well production includes sand, the sand would settle out when the pumping unit was stopped and clog or damage the unit. Also, if the well is producing a significant amount of water in a very cold climate, the water could turn to ice and damage a stopped pumping unit. Therefore, for these and other reasons, it may not be desirable to stop the pumping unit, but it is also not desirable to pump the well dry and subject the pumping unit to fluid pound and damage.

The present invention is directed to a method and operation for controlling the pumping speed of a rod pumped liquid producing well in which the pump may continue to pump but the pumping speed is varied for preventing the well from being pumped dry. Preferably, the method and apparatus of the present invention is directed to controlling a well pumping unit for maintaining a substantially constant amount of filling of a rod actuated liquid well pump thereby avoiding the problem of pump off or pumping the well dry thereby avoiding also the problem of shutting down the well due to pump off.

SUMMARY

One object of the present invention is the provision of a method and apparatus for controlling the pumping speed of a liquid well pump actuated by a polished rod which is reciprocated by a prime mover. The method includes measuring the load in the polished rod and measuring the position of the polished rod in the well and periodically using the measurements of load and position to determine the amount of filling of the pump. After measuring changes, the method consists of continuing pumping but varying the pumping speed in response to changes in the amount of filling of the pump for preventing the pump from being pumped dry.

Another object of the present invention is the provision of a method and apparatus of maintaining a substantially constant amount of filling of a liquid well pump actuated by a polished rod which is reciprocated by a prime mover which includes measuring the load in the polished rod and measuring the position of the polished rod in the well. Periodically, the measurements of load and position are used to determine the amount of filling of the pump, and the change of the amount of filling of the pump of one pumping cycle is compared relative to a previous pumping cycle, and the speed of actuation of the pump is varied as a function of the change in the amount of filling of the pump to maintain a substantially constant amount of filling of the pump.

A still further object of the present invention includes varying the speed of a prime mover which may be any suitable prime mover such as an engine or motor. In one embodiment the speed of an electric prime mover is controlled by a variable frequency drive.

Still a further object of the present invention is the method and apparatus of comparing the change of the amount of filling of the pump by comparing the position measurements between two different pumping cycles on the downstroke at a predetermined load measurement.

Still a further object of the present invention is wherein the speed of the pumping unit is varied to maintain the position measurement on the downstroke between two set positions at a predetermined load measurement.

Still a further object of the present invention is comparing the change of the amount of filling by comparing the change in the position measurements between two different pumping cycles on the downstroke at a predetermined load measurement and relative to the length of the stroke of the position measurement.

Other further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
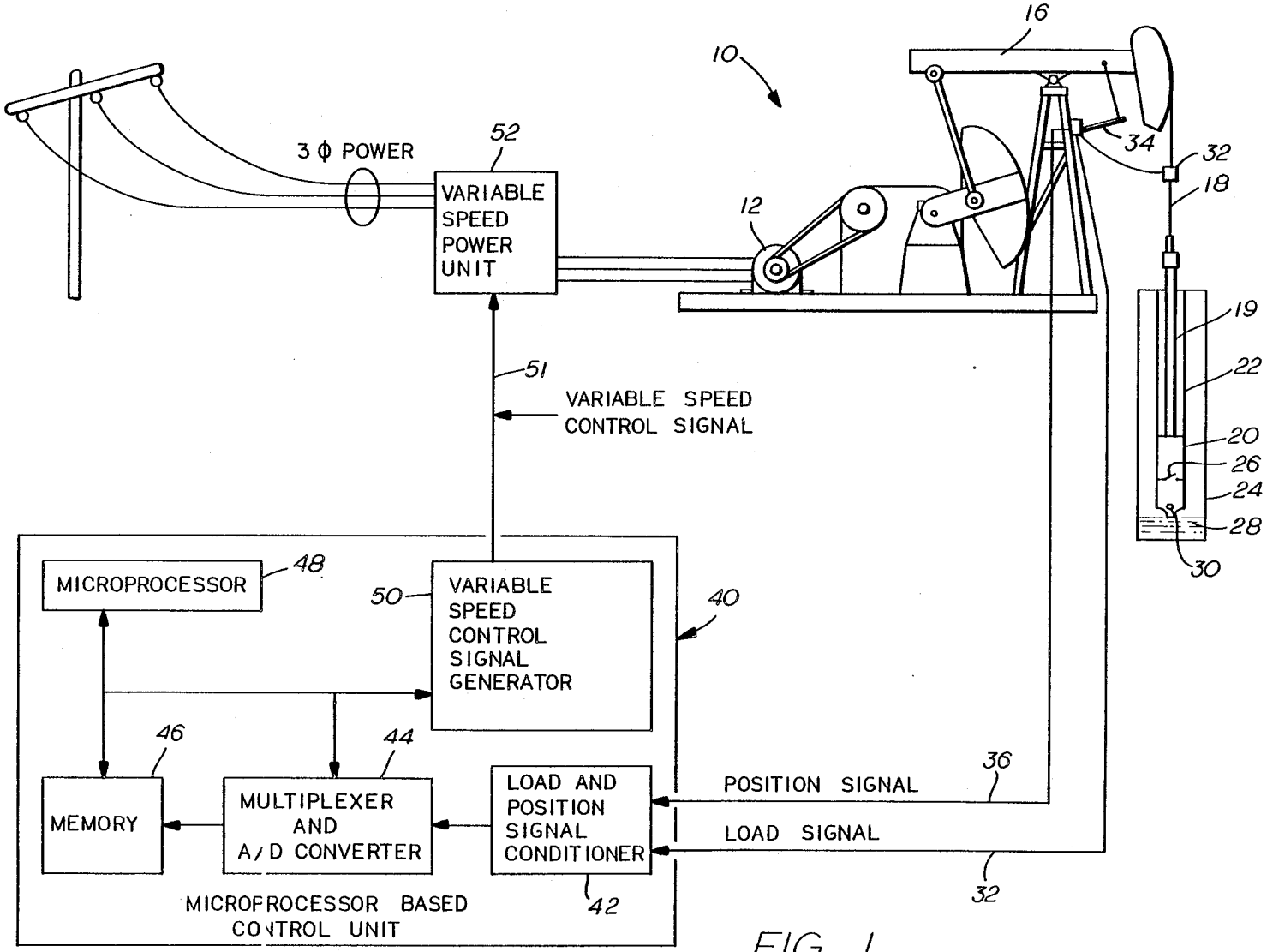
FIG. 1 is a schematic elevational view of the pumping unit of the present invention.

Referring now to the drawings, and particularly to FIG. 1, an oil well pumping unit generally indicated by the reference numeral 10 is shown which includes any suitable prime mover such as an engine or motor, but here shown as an electrical induction motor 12 which in turn drives a gear box 14 to alternately reciprocate a walking beam 16 which in turn reciprocates a polished rod 18 and rod string 19 for actuating a well pump 20 in a production tubing 22 in a well 24. As is conventional, the pump 22 includes a traveling valve 26 and a standing valve 30 which admits well fluid 28 into the tubing 22.

Two measuring means or transducers are mounted on the pumping unit. A load measuring means or transducer 32, which may be a conventional strain gauge load cell, is connected to the polished rod 18 for providing an output signal which is proportional to the load on the polished rod. A position measuring means or transducer 34 measures the vertical position of the polished rod 18 and may be a potentiometer having an actuating arm which is connected to the walking beam 16 which provides a voltage output which is proportional to the angle of the walking beam and thus to the vertical position of the polished rod 18.

The oil field pumping unit is driven by the prime mover 12 to reciprocate the polished rod 18 and rod string 19 and pump 20 for pumping the liquid from the well 24. However, the well pumping unit may become damaged when the well has been pumped dry and numerous types of control means have been used in the past to stop the prime mover 12 when the well has been pumped off.

However, the present invention is directed to controlling the pumping speed of the polished rod 18 so the pump unit need not be stopped as occurs in normal pumpoff controllers. In the Preferred embodiment illustrated in FIG. 1 the position signal 36 and the load signal 38 from the position measuring potentiometer 34 and the load measuring strain gauge 32, respectively, are transmitted to a controller 40 which includes a load and position signal conditioner 42 for conditioning the received analog signals, a multiplexer and analog to digial converter 44 which transmits digital signals to a memory 46. A microprocessor 48, such as a Delta-X Corporation Model DXI-40A controller, uses the information in the memory 46 and produces a signal to a variable speed control signal generator 50 which produces an output signal 51, for example, four to twenty MA which controls a variable speed power unit 52 connected to a suitable power source 54 which provides a variable frequency drive to the induction motor 12 for varying the speed of the polished rod 18. However, other types of control systems and prime movers 12 may be utilized to vary the speed of the rod 18 such as an internal combustion engine in which its speed is controlled by adjusting its throttle or by adjusting the speed ratio of the gear box 14.

Figure 3:
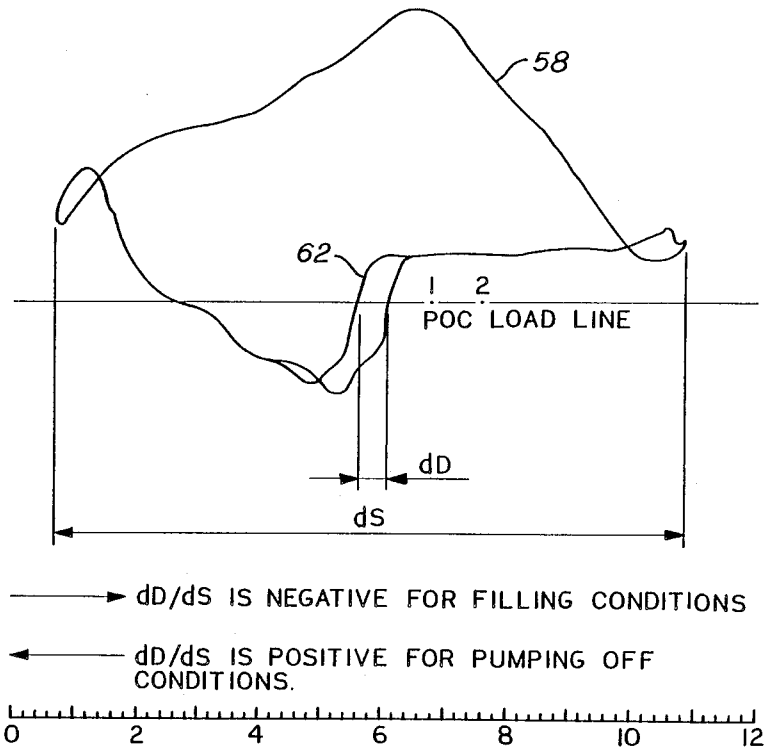
FIG. 3 is a graph similar to FIG. 2 showing changes in the operating characteristics of the well being pumped.
Figure 2:
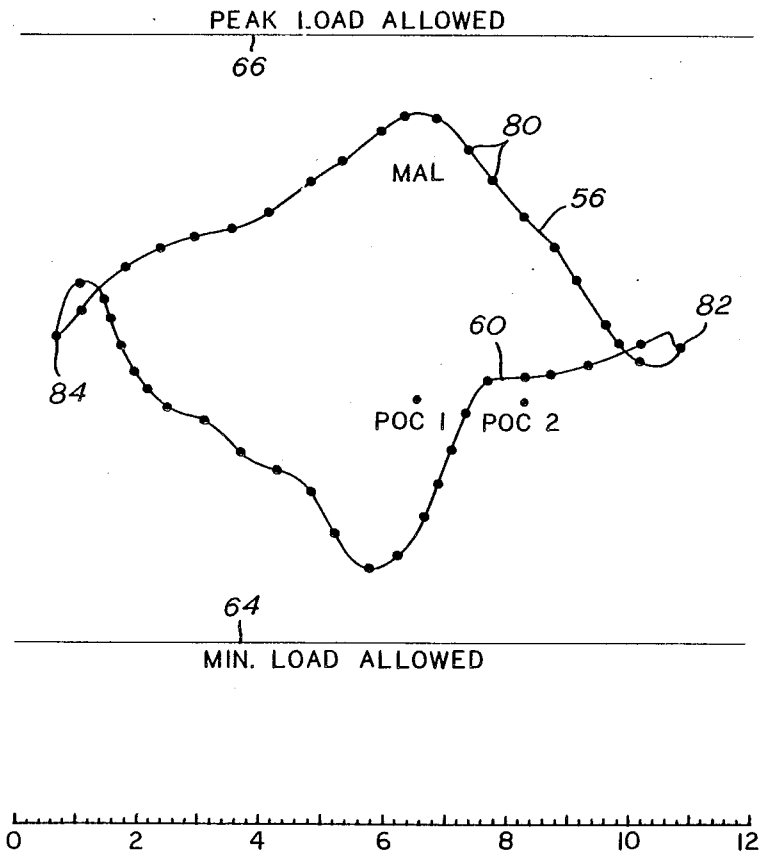
FIG. 2 is a graph of load versus position of a rod pumping unit system illustrating the theory of the present invention.

The controller 40 at fixed intervals receives the position 36 and load 38 signals and stores them in the memory 46 for storing inputs which are in effect graphs 56 and 58 shown in FIGS. 2 and 3, similar to that obtained by connecting the signals 36 and 38 to an X-Y plotter to provide a pump graph.

The controller 40 uses the position signal 36 and load signal 38 to compute both the rate of change in pumpoff conditions and the degree of pumpoff. Then, the microprocessor 48 actuates the signal generator 50 to provide an output current signal 51 to the variable speed unit 52 so that the operating frequency of the motor 12 is increased or decreased as necessary to control the speed of the polished rod 18 to cause the downstroke curve portion 60 (FIG. 2) to stabilize and neither show continued pumping off or filling. A set point window is set, for example, approximately on the standing valve load of the well, and can be as wide as desired, or decreased to become a single point rather than a window. The controller variable window set points are "POC1" or point 1 for the left-hand set point and "POC2" or point 2 for the right-hand set point as seen in FIGS. 2 and 3, and are programmed by the operator depending upon the pumping unit 10 and the characteristics of the well reservoir. It is to be noted that the load coordinate is the same for both set points and also that POC2 may not be to the left of POC1. POC1 is set to the right of a pumpoff condition 62 (FIG. 3) and preferably points 1 and 2 are set as far as possible to the right, depending upon conditions, to obtain the maximum amount of filling of the pump and thus the maximum well fluid production from the well. The following formula is used for calculating the new output current after a change in the amount of filling of the pump is detected:

$$(1)\ mA2=(K+mA1)\,(1-dD/dS)-K$$

which may be rewritten as:

$$(2)\ mA2=mA1\,(1-dD/dS)\,K\,(dD/dS)$$

where mA2 is the new output current; mA1 is the present output current; dD is the change in the position coordinate of the graph 58 (FIG. 3) as it crosses the POC load line in the downstroke, dS is the stroke length; and K is a predetermined factor. The downstroke sampled for calculating dD/dS may be separated by a number of strokes which the variable, "update interval", is set to. The "K" factor is programmed by the operator and, for example, may range between 0.01 and 20.00, and affects the step change made to the output current for stopping the downstroke curve of graphs 56 or 58 from showing continued pumping off or filling. The sign of dD/dS will be positive if the well is pumping off, and negative when the well is filling. The range of dD/dS can be from zero (the graph shape is stabilized) to one (maximum rate of pumping off or filling).

Therefore, the method includes periodically using the measurements of load and position to determine the amount of filling of the pump and thereafter comparing the change of the amount of filling of the pump as determined by the factor of dD/dS of one pumping cycle relative to a previous pumping cycle. This measurement can be made as often as every stroke or greater, such as once every 255 strokes, as programmed into the controller 40. Thereafter, using the above formulas, the output current 51 to the variable speed unit 52 varies the speed of actuation of the motor 12 and thus of the pump as a function of the change in the amount of filling of the pump to maintain a substantially constant amount of filling of the pump. The amount of filling of the pump will depend upon the placement of the set points POC1 and POC2.

Other methods may be used to measure the change of the amount of filling of the pump of one pumping cycle relative to a previous pumping cycle. For example, the change in the amount of filling can be determined by calculating the coefficients of the Fourier series. That is, the general equation of any periodic wave such as graphs 56 or 58 is $$Y = Y_1 \sin(\omega t + \theta_1) + Y_2 \sin(2\omega t + \theta_2) + \ldots + Y_n \sin(n\omega t + \theta_n) + X_1 \cos(\omega t + \theta_1) + X_2 \cos({}_2\theta t + \theta_2) + \ldots X_n \cos({}_n\theta t + \theta_n)$$

wherein Y is the ordinate of the resultant wave and $Y_1$, $Y_2 \ldots Y_n$ and $X_1$, $X_2$—$X_n$ are the maximum ordinates or amplitudes of the first, second . . . $n^{th}$ harmonics. Therefore, by calculating the coefficient of the Fourier series of the graph 56 or 58 and comparing the changes in their coefficients the change in the amount of filling of a pump from one pumping cycle relative to a previous pumping cycle can be compared. Then the pumping speed of the polished rod 18 would be controlled to maintain the Fourier coefficients between compared cycles to a constant value.

If desired, various malfunction detectors and other operating restrictions can be provided. For example, referring to FIG. 2, a minimum allowable load 64 and a maximum or peak allowable load 66 are programmable and can be set by the operator of the controller 40. If at any time the measured load by the load measuring strain gauge 32 exceeds the maximum or is below the minimum loads programmed, the output current is decreased by a predetermined amount, such as 3%, of the present value in order to slow the pumping unit down as both of these problems can be caused by operating the pumping unit too fast. The load is tested for these limits once every 20 milliseconds. If the load limits continue to be exceeded, and the output current has been reduced to its preset minimum value, then the well will be shut off on a peak load or minimum load malfunction, whichever occurred. The well will stay down until operator intervention resets the malfunctions. Furthermore, for any stroke which results in a load violation, output current updates due to changes in pumpoff (filling) rate or degree are disabled for the following two strokes maximum. Note that the peak load testing may be disabled by setting the peak load allowed to a predetermined value such as 34500 pounds, and that the minimum load testing may also be disabled by setting the minimum load allowed to a predetermined value, such as 0 pounds.

The pumping speed may be measured every stroke. This provides for a more accurate control of the pumping speed. The controller 40 allows up to a predetermined time, such as 2.5 minutes maximum to determine the well speed. If no change in the position signal can be measured in 2.5 minutes the controller will cycle into downtime and report a well speed violation. After downtime is over, the controller will cycle into minimum pump time and attempt to redetermine the well speed. Should the controller be able to measure the well speed it will continue to operate, but the alarm for well speed violation will remain set until cleared by the operator to warn of any problems. Downtime and minimum pump time are programmable by the operator and may range, for example, between 1 and 255 minutes. Minimum pump time sets the amount of time the controller must wait before making any output current adjustments (pumpoff detection) after coming out of downtime.

A malfunction setpoint MAL (FIG. 2) may be used, and is operator programmable. It is used in conjunction with another controller variable named "consecutive malfunctions allowable," which is also operator programmable. The setpoint MAL is a point inside the graph 56 which detects when the upstroke load drops below it. Should this happen two strokes in a row, the controller 40 will cycle the well into downtime. This event will also represent one consecutive malfunction as well as one commulative malfunction. After downtime and minimum pump time are over, if the same graph conditions exist, the well will again be cycled into downtime, and another consecutive and commulative malfunction be counted. Once the consecutive malfunctions occurred equals those allowed, the well will be shut down on a setpoint malfunction, and remain so until operator intervention to reset malfunctions occurs. A single good stroke after minimum pump time will reset the consecutive malfunctions to zero, but not affect the commulative malfunctions occurred. The consecutive malfunctions allowable may be set between 1 and 255.

A minimum and maximum output current allowed is operator programmable and may range between preset limits such as 4.00 mA to 20.00 mA. The maximum must be set equal or higher than the minimum allowed. These values set the range over which the output current may be adjusted by the controller.

Figure 4:
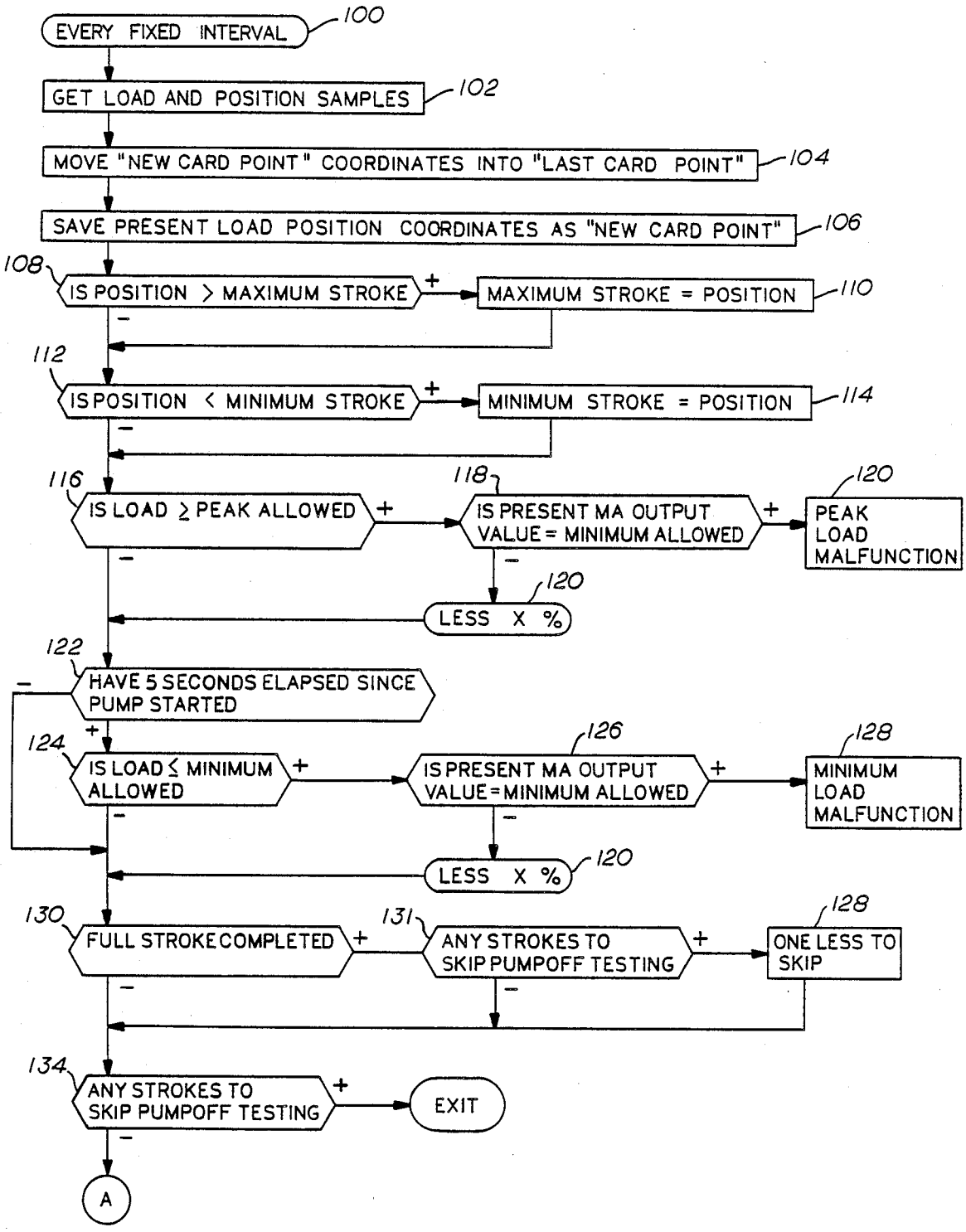
FIGS. 4 through 11 are logic flow diagrams of the software used in the present invention.

Referring now to FIG. 4, the logic flow diagram operating the controller 40 is best seen. In step 100 the controller 40 is actuated at predetermined fixed intervals such as 20 milliseconds to read the load and position signals in step 102 from lines 36 and 38 (FIG. 1) to provide a plurality of points 80 (FIG. 2) defining the load and position graph 56 for a single pumping cycle. At step 104 the position and load coordinates for the latest measured pumping cycle is moved into the memory 46 as the "last card point" and in step 106 the new load and position coordinates are loaded in the memory 46 as the "new card point".

In step 108 the position of point 82 (FIG. 2) of the new card point is compared to the prior stored maximum stroke and if the new position 82 is greater then step 110 is taken to substitute the new position of point 82 as the new maximum point. This information is used in determining dS. Step 112 is then undertaken which compares the position of point 84 (FIG. 2) with the stored minimum stroke and if it is less than the stored minimum stroke step 114 is performed to store the new position measurement in the memory as the minimum stroke thereby completing the information needed to determine dS.

Figure 9:
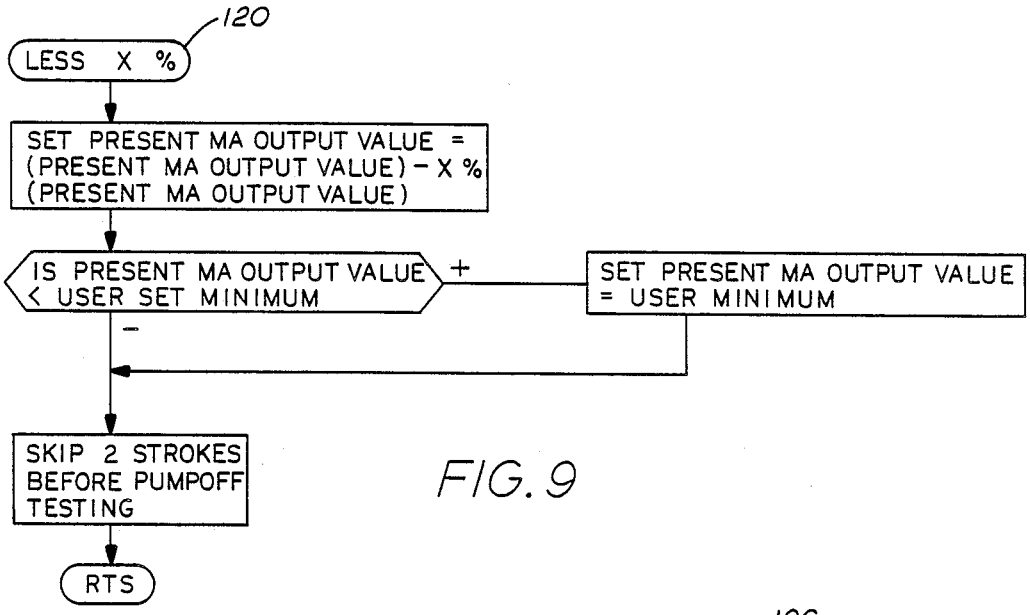

In step 116 the greatest load in the graph 56 is measured to determine if it is greater than the maximum or peak allowed load 66 (FIG. 2) and if the answer is yes, step 118 determines whether or not the output signal 51 of the present signal is equal to the minimum, in the present example 4 mA, and if so step 120 indicates that there is a peak load malfunction in the pumping unit. However, in step 118 if the present output signal is greater than the minimum, here for example 4 mA, then program 120 (FIG. 9) is actuated which basically reduces the output signal a predetermined amount, such as 3%, to slow down the pumping unit in an attempt to avoid peak load malfunction.

Step 122 insures that a five second delay has elapsed and if so step 124 measures the minimum load on the graph 56 to determine if it is below the minimum load allowed 64 (FIG. 2). Again in step 126 if the load is less than the preset minimum the comparison is made to determine whether or not the signal output 51 is already equal to the preset minimum allowed and if so a minimum load malfunction signal 128 is given. If the output signal on line 51 is greater than the minimum, then program 120 (FIG. 9) is again performed to reduce the output signal 51 and slow down the pump to avoid the minimum load malfunction problem.

In step 130 a determination is made whether or not a full or complete pumping cycle has been completed and if the answer is yes step 131 determines whether or not there are any more strokes to be performed before pumpoff testing. That is, pumpoff testing can be made every stroke or only at predetermined stroke intervals and steps 131, 132 and 134 determine when a cycle is to be pumpoff tested.

Figure 5:
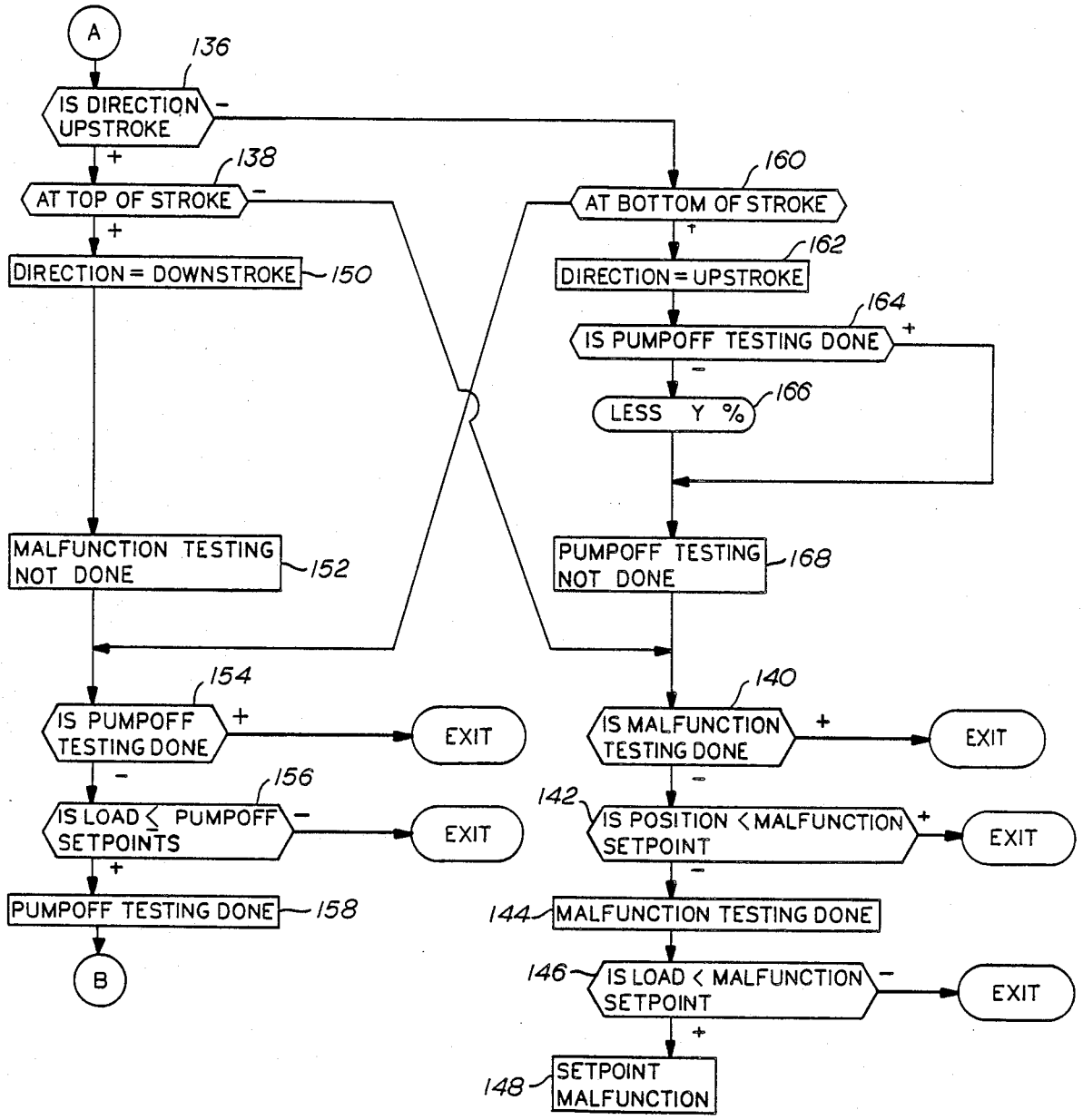

If step 134 determines it is time to perform pumpoff and malfunction testing the program continues in FIG. 5. Step 136 determines whether the pumping cycle is in the upstroke direction and if yes step 138 determines when it reaches the top of the stroke and if no it proceeds to step 140 to determine if malfunction testing is done. If not, the present position point of this upstroke is compared with the malfunction MAL set point and measurements are made and compared in steps 142, 144, 146 and 148 to determine whether or not the position and load are less than the malfunction set point to indicate a malfunction readout.

Step 138 indicated that the top of the stroke was reached and step 150 determines that the direction is now in the downstroke and step 152 indicates that the malfunction testing is not done on the downstroke, and step 154 inquires whether the pumpoff testing is done and if no whether or not the present load is equal or less than the pumpoff set points POC1 and POC2 and if so step 158 is to initiate the pumpoff testing.

Figure 10:
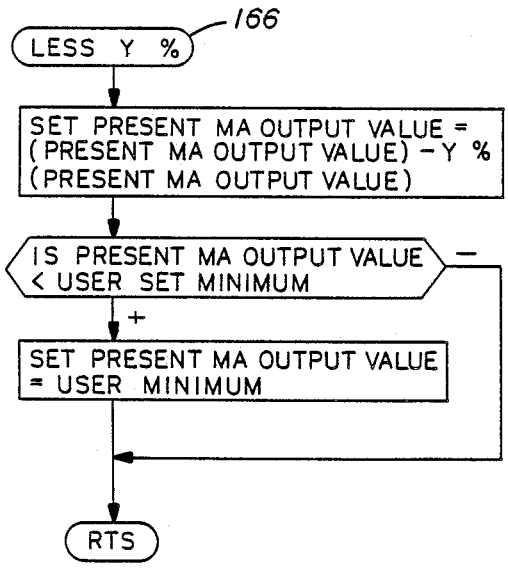

Again from step 136 if the direction is not upstroke, step 160 determines when bottom is reached to move to the upstroke in step 162. Step 164 determines whether or not pumpoff testing is done and if not program 166 (FIG. 10). This condition indicates that the load in this downstroke never dropped below the load line of POC1 and POC2. Without this occurring, control over the well is lost. By slowing the pump, the load will drop and cross that load line of POC1 and POC2, and control will be regained.

Figure 6:
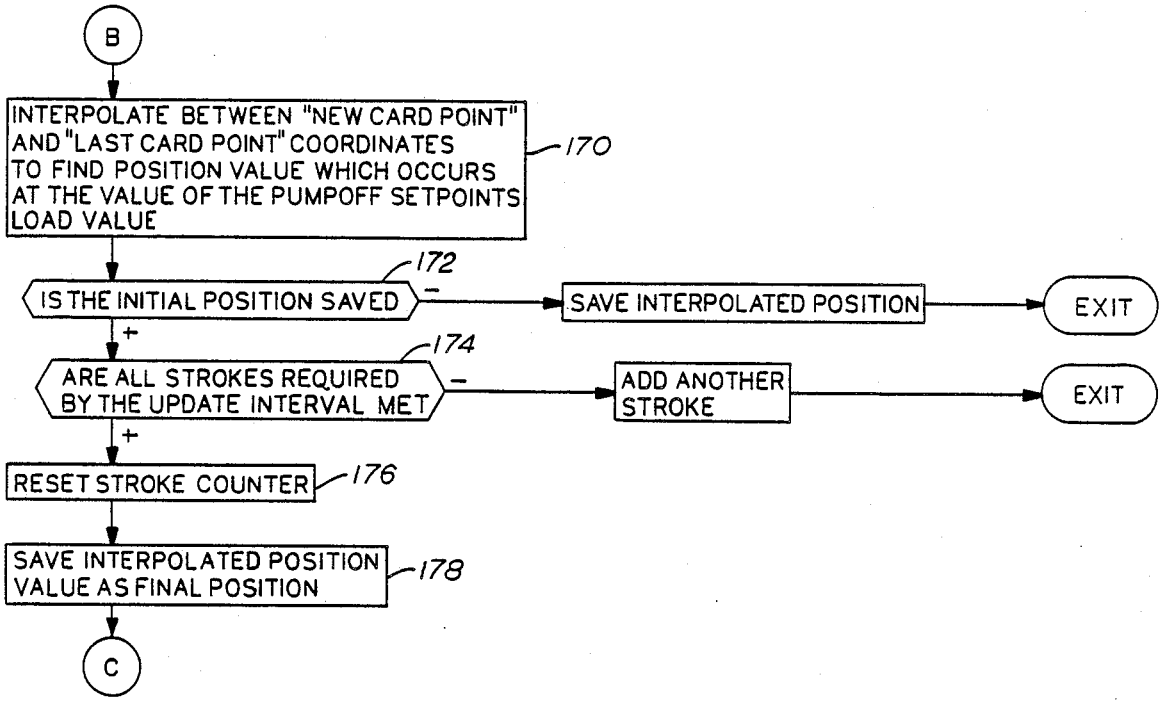

The pumpoff testing begins in FIG. 6. As noted from FIG. 2 the graph 56 is made up of a plurality of measured points 80, one of which may or may not be at the load point of set points POC1 and POC2. In this event, in order to obtain the dD measurement, which is the comparison of positions between two different cycles at the set point load value, it may be necessary to run a mathematical interpolation. Therefore, step 170 interpolates between the new card point and the last card point coordinates to determine the position value which occurs at the load of the set points POC1 and POC2. Steps 172, 174, 176 and 178 save the initial position and save the interpolated position as the final position assuming that the number of strokes has been reached to make a measurement and comparison.

Figure 7:
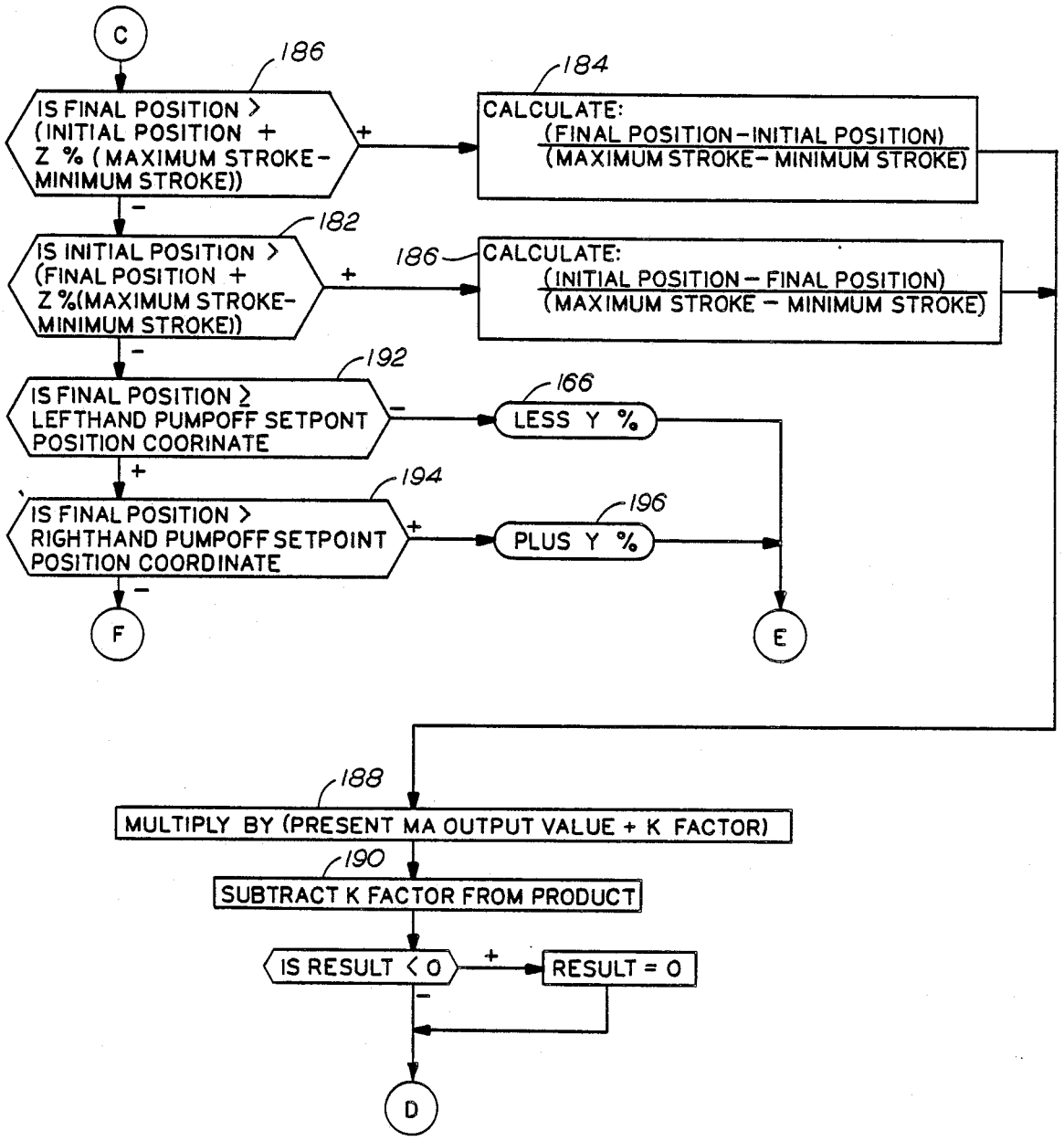
Figure 11:
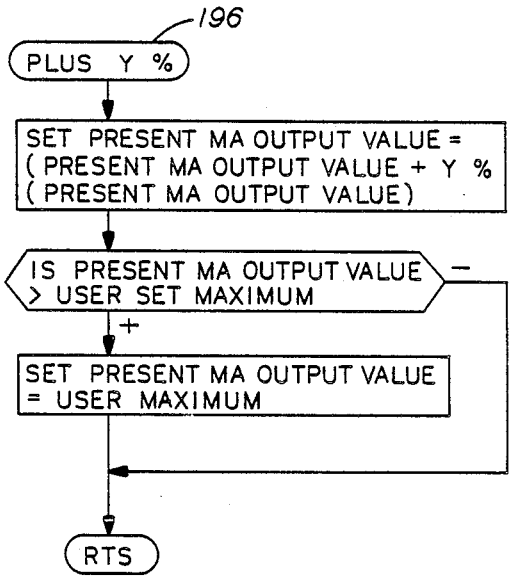

Once the final and initial positions between two strokes to be compared are determined, calculations are made, as best seen in FIG. 7 to determine whether or not the output signal 51 should be changed and how much. Steps 180 and 182 determine whether or not the final and initial positions are within the window between set points 1 and 2. If they are, and if the final position is greater than the initial position, as determined in step 180 then step 184 is used to calculate dD/dS, but if the initial position is greater than the final position then step 186 is used to calculate dD/dS. In either event a calculation is made in steps 188 and 190 to solve equation (1). On the other hand, if the final position is not within the window between the set points 1 and 2, as determined in steps 192 and 194, the program goes to routines 166 (FIG. 10) and 196 (FIG. 11) to reset the output signal, respectively, but within the minimum and maximum values programmed for the output signal.

Figure 8:
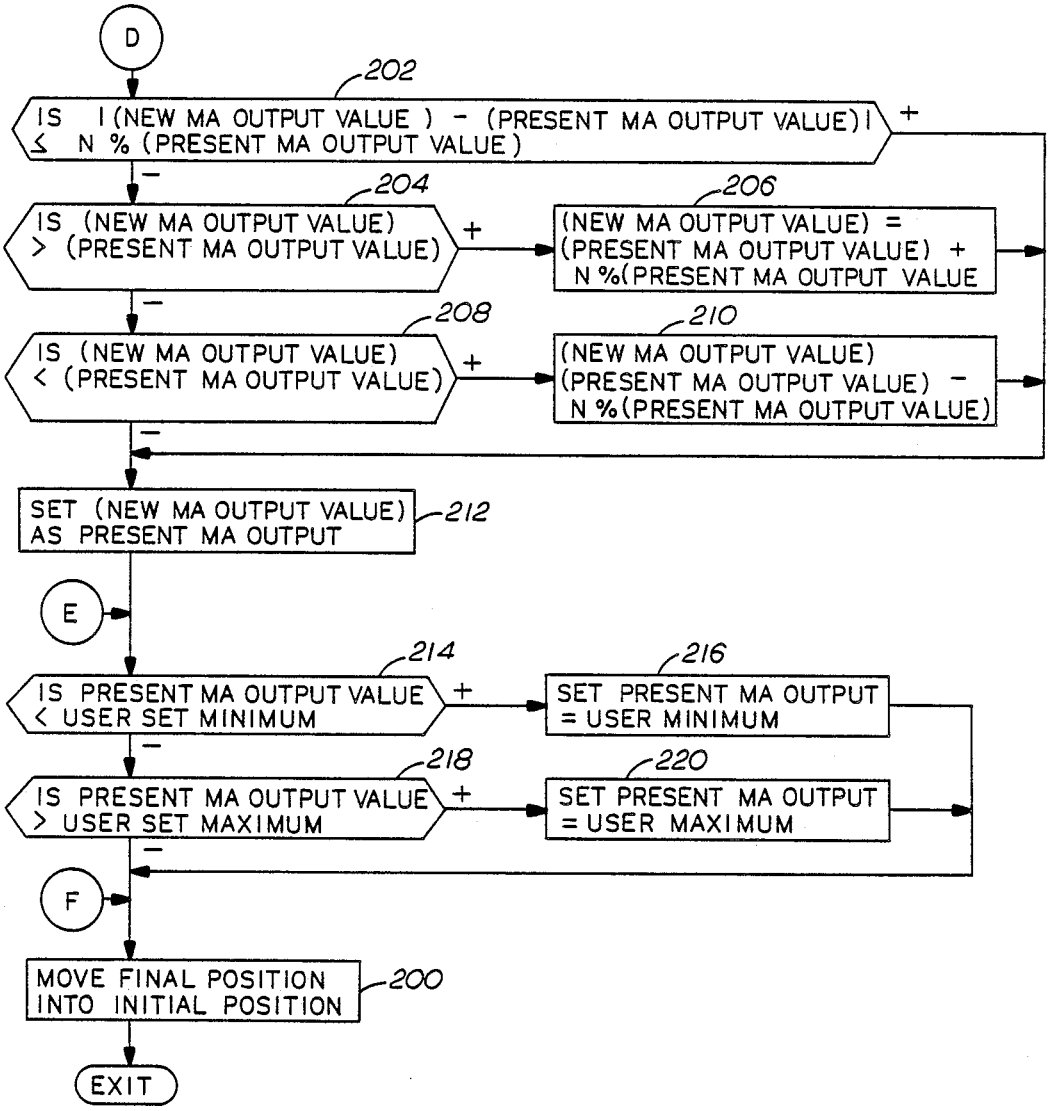

After the steps reach either path E or F, they are transmitted to FIG. 8 and to step 200 to move the final position into the initial position for preparation for the next comparison cycle.

Returning to the calculations made in steps 188 and 190 in FIG. 7 the result is determined and transmitted to steps 202, 204, 206, 208 and 210 in FIG. 8. In 202, if the difference between the new and present mA output signal is less than a predetermined percent of the present mA output value such as 50 percent, the signal is sent to step 212 wherein the new output value is transferred to be the present mA output value. If the difference is greater than the predetermined amount, steps 204 and 208 are used to actuate steps 206 and 210, respectively, to change the new mA output value a predetermined amount which is then transmitted to 212 to be used as the present mA output. From 212 the present mA outputs are set in steps 214, 216, 218 and 220 to insure that they are within the maximum and minimum allowed user range which has been preprogrammed. After conclusion of the program, the program is repeated for additional cycles.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts and steps of the method will be readily apparent to those skilled in the art and which are encompassed within the spirit of the invention and the scope of the appended claims.

What is claimed is:

1. A method of maintaining a substantially constant amount of filling of a liquid well pump actuated by a rod which is reciprocated by a prime mover comprising,
   load measuring means connected to the rod measuring the load in the rod,
   measuring the position of the rod in the well,
   periodically using the measurements of load and position to determine the amount of filling of the pump,
   comparing the change of the amount of filling of pump of one pumping cycle relative to a previous pumping cycle,
   varying the speed of actuation of the pump as a function of the change in the amount of filling of the pump to maintain a substantially constant amount of filling of the pump, and
   comparing the change of the amount of filling by comparing the position measurements between two different pumping cycles on the downstroke at a predetermined load measurement.

2. The method of claim 1 wherein the speed of the pumping unit is varied to maintain the position measurement on the downstroke between two set positions at a predetermined load measurement.

3. A method of maintaining a substantially constant amount of filling of a liquid well pump actuated by a rod which is reciprocated by a prime mover comprising,
   measuring the load in the rod,
   measuring the position of the rod in the well,
   periodically using the measurements of load and position to determine the amount of filling of the pump,
   comparing the change of the amount of filling of pump, of one pumping cycle relative to a previous pumping cycle,
   varying the speed of actuation of the pump as a function of the change in the amount of filling of the pump to maintain a substantially constant amount of filling of the pump, and
   comparing the change of the amount of filling by comparing the position measurements between two different pumping cycles by calculating and comparing the change in the coefficients of the Fourier series of the position measurements.

4. A method of maintaining a substantially constant amount of filling of a liquid well pump actuated by a rod which is reciprocated by a prime mover comprising,
   measuring the load in the rod,
   measuring the position of the rod in the well,
   periodically using the measurements of load and position to determine the amount of filling of the pump, comparing the change of the amount of filling of pump of one pumping cycle relative to a previous pumping cycle, varying the speed of actuation of the pump as a function of the change in the amount of filling of the pump to maintain a substantially constant amount of filling of the pump, and comparing the change of the amount of filling as determined by the factor of dD/dS of one pumping cycle relative to a previous pumping cycle, where dD is the change of position measurement in the downstroke at a predetermined load level and dS is the stroke length.

* * * * *